United States Patent [19]

Cory

[11] Patent Number: 4,593,911

[45] Date of Patent: Jun. 10, 1986

[54] ORBITING ACTION DEVICE

[75] Inventor: Richard Cory, Bloomingburg, N.Y.

[73] Assignee: Bruce R. Doyle, Newton, N.J. ; a part interest

[21] Appl. No.: 735,259

[22] Filed: May 17, 1985

[51] Int. Cl.[4] ..... A63F 7/00

[52] U.S. Cl. ..... 273/322; 273/109; 446/170

[58] Field of Search ..... 273/322, 109, 116; 446/168, 170

[56] References Cited

U.S. PATENT DOCUMENTS

| | | | |
|---|---|---|---|
| 2,242,450 | 5/1941 | Carballal | 273/322 |
| 2,644,270 | 7/1953 | Marong | 446/70 |
| 3,132,441 | 5/1964 | Mahovsky | 446/170 |
| 3,423,872 | 1/1969 | Dodson | 446/170 |
| 3,502,335 | 3/1970 | Sholin | 273/109 X |
| 3,697,074 | 10/1972 | Duncan | 273/109 X |
| 3,702,191 | 11/1972 | Zilius et al. | 446/170 X |
| 3,758,981 | 9/1973 | Hlasnicek et al. | 446/170 |
| 4,429,487 | 2/1984 | Taylor et al. | 446/168 |
| 4,515,373 | 5/1985 | Hirshfeld | 273/109 X |

*Primary Examiner*—William H. Grieb

*Attorney, Agent, or Firm*—Kirschstein, Kirschstein, Ottinger & Israel

[57] ABSTRACT

A manual dexterity toy in which a ball is caused to orbit along elliptical trajectories within the toy for as long as possible without having the ball escape to the exterior of the toy.

12 Claims, 3 Drawing Figures

ORBITING ACTION DEVICE

BACKGROUND OF THE INVENTION

1. Field of the Invention

This invention relates to an orbiting action device intended to be held in the hands of children and/or adults and manipulated by movement of the hands, wrists and/or arms, in combination with body and other limb movements, if desired, so as to effect orbiting movement of a movable object within the device in a required manner, with such orbiting movement requiring an element of skill to attain and maintain, thus providing a device which can provide endless amusement as a toy when used for recreational purposes, manual dexterity and exercise as an exercising aid when used for physical cultural purposes, and education as a demonstration aid when used for scientific and educational purposes.

2. Description of the Prior Art

Manually-manipulatable toy devices requiring an element of manual dexterity are known and are disclosed, for example, in the following U.S. Pat. Nos. 3,132,441; 3,423,872; 3,502,335; 3,702,191; 3,758,981 and 4,429,487. Such prior devices are manipulated to cause a ball to travel along a desired path or track, the ball always being in physical contact with a track or guiding surface of the device during the proper manipulation thereof.

Although generally satisfactory for their intended purposes, such prior devices do not require a high element of dexterity or skill to cause the ball to travel along the desired track due, primarily, to the fact that the ball always engages the track throughout the proper manipulation of the device. Older children and, particularly, adults are prone to become quickly bored with such devices which do not require a high element of skill and which are essentially too easy to master.

SUMMARY OF THE INVENTION

1. Objects of the Invention

It is an object of this invention to overcome the aforementioned drawbacks of such prior art devices.

It is another object of this invention to provide a manually-manipulatable device suitable for children and adults which requires a high level of manual dexterity and skill to manipulate properly.

It is a further object of this invention to provide such a device whose skill level is adjustable to suit the individual requirements of a particular user.

It is yet another object of this invention to provide such a device which is of a relatively simple construction and durable, and which may be manufactured and marketed at a relatively low cost.

It is still another object of this invention to provide a device which can provide a rich entertainment reward when used for recreational purposes.

It is another object of this invention to provide a device which can be used as an exercising and therapy aid when used for physical cultural purposes.

It is a still further object of this invention to provide a device which can be used as a scientific demonstration aid when used for scientific and educational purposes.

2. Features of the Invention

In keeping with these objects and others which will become apparent hereinafter, one feature of the invention resides, briefly stated, in a manually-manipulatable action device or toy which comprises a pair of generally dome-shaped hollow members, means for spacing the members apart from each other, and a ball movable in repetitive endless trajectories between the members in response to proper manual skillful manipulation of the toy.

More particularly, each member has a closed side, an open side and a curved wall between the closed and open sides thereof. The members are arranged in a mirror symmetrical relationship with the open side of one member facing the open side of the other member. Each curved wall has an interior ball-guiding surface at the interior of the toy, and an exterior surface at the exterior of the toy. When, in a preferred embodiment, each hollow member has a semi-spherical configuration, each interior ball-guiding surface is concavely curved. Also, in a preferred case, an annular flange, of a sufficient size to be gripped by a user's fingertips, is provided on each member at the respective open side thereof.

The spacing means spaces the members at a clearance between the open sides of the members. The open sides freely communicate with one another and with the exterior of the toy through the clearance. In a preferred embodiment, the spacing means includes a plurality of elongated support posts equiangularly spaced apart from each other and arranged in an annulus about an axis. All the posts have the same length so that the clearance has the same size throughout its circumferential extent.

The ball is caused to move along said trajectories by the user who is holding the flanges with his or her fingertips and who moves the hands, wrists and/or arms in combination with body and other limb movements, if desired. In each trajectory, the ball travels in rolling engagement along the interior ball-guiding surface of one of the members with sufficient momentum to pass through the open side thereof and to span the clearance in a free-flying manner in one direction; and thereupon, the ball travels in rolling engagement along the interior ball-guiding surface of the other of the members with sufficient momentum to pass through the open side thereof and to span the clearance in a free-flying manner in a countercurrent direction which is opposite to said one direction. The object is to continue the manipulating movements and thus keep the ball moving in its orbital paths for as long as possible; the longer, the better.

The ball is dimensioned to be smaller than the clearance. To initiate the ball movement, the ball is initially freely insertable, i.e. without mechanical interference, through the clearance and dropped into the interior of the toy. When the toy is improperly or unskillfully manipulated, then the ball is free to escape through the clearance to the exterior of the toy.

As previously described, the ball "flies" across the clearance, twice each trajectory. During such flight, the ball is obviously not in physical engagement with any portion of the toy and, thus, is not being positively guided during this portion of the trajectory. This is in direct contrast to prior art devices which always positively guide the ball by providing direct contact between the ball and the toy throughout the path along which the ball is guided. Since, in accordance with the invention, the ball is not being positively guided at certain portions of the trajectory, a high element of dexterity and skill is required to insure that the ball does not escape from the interior of the toy. It is this high skill factor, among other things, which renders the toy endlessly amusing and rich in entertainment reward.

Another feature of this invention is embodied in changing the size of the clearance so as to adjust the skill level required. The greater the clearance, the more skill is required to keep the ball within the toy. Thus, a particular user who gains skill at a particular clearance size can continue to challenge himself or herself by increasing the size of the clearance.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
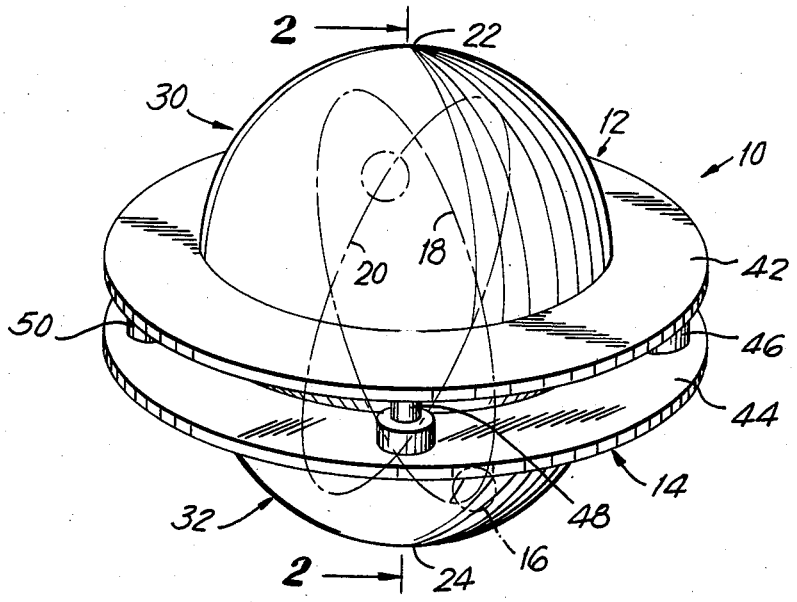
FIG. 1 is a perspective view of the toy with two representative trajectories of a ball in dashed lines in accordance with one embodiment of the invention.

Referring now to the drawings, reference numeral 10 generally identifies a manually-manipulatable action device or toy comprising a pair of generally dome-shaped hollow members 12 and 14 spaced apart from each other, and a ball 16 movable in repetitive endless trajectories, e.g. 18 and 20, schematically represented by dashed lines in FIG. 1, between the members 12, 14 in response to proper manual skillful manipulation of the toy. Although only one ball 16 has been shown in the drawings for the sake of simplification, it will be understood that two or more balls can be simultaneously caused to move in repetitive endless trajectories within the toy when the same is manipulated. The movement of more than one ball, of course, increases the skill level required to maintain the balls within the toy, as described in greater detail below.

Figure 2:
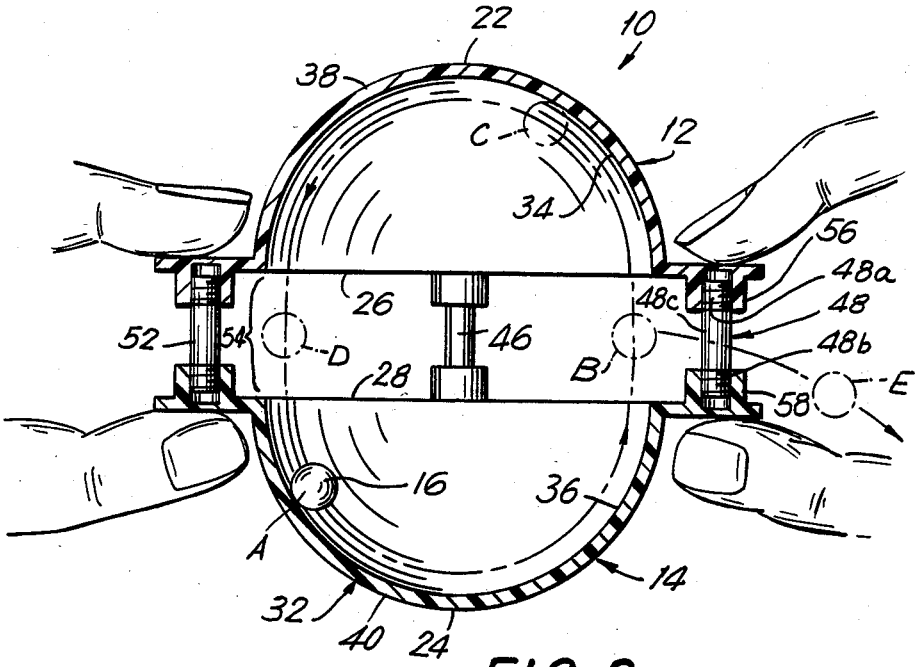
FIG. 2 is a sectional view taken on line 2—2 of FIG. 1, showing a user's fingers in broken-away view.

Hollow members 12, 14, respectively, have closed ends or sides 22, 24; open ends or sides 26, 28; and curved walls 30, 32 between the closed sides 22, 24 and the open sides 26, 28. The members 12, 14 are arranged in a mirror symmetrical relationship with the open side 26 of member 12 facing, and juxtaposed with, the open side 28 of member 14. The closed sides 22, 24 are further away from each other than the open sides 26, 28. As best shown in FIG. 2, curved walls 30, 32, respectively, have interior ball-guiding surfaces 34, 36 at the interior of the toy, and an exterior surface 38, 40 at the exterior of the toy.

Each member 12, 14 preferably has a semi-spherical configuration, and the interior ball-guiding surfaces 34, 36 are concavely curved.

Each hollow member 12, 14 has an integral brim portion or annular flange 42, 44 surrounding the open sides 26, 28 of the members 12, 14 and extending outwardly away from the interior of the toy. Each flange 42, 44 projects outwardly by a sufficient amount to enable the flange to be gripped by the fingers of a user. The flanges thus serve as convenient hand-holds by which the toy can be held anywhere along the circumferential extent of the flanges. A roughened surface or shallow cutouts (non-illustrated) for receiving the fingertips may be provided at a selected location on the flanges to facilitate a better mechanical feel or grip for the user.

Means including a plurality of elongated support posts 46, 48, 50, 52 are provided for spacing the members 12, 14 apart from each other at a predetermined distance or clearance 54 between the open sides 26, 28, or, put another way, between the flanges 42, 44 of the members 12, 14. The support posts are equiangularly spaced apart from each other in an annulus about an axis along which the posts extend in mutual parallelism, said axis being colinear with the one about which the annular flanges 42, 44 extend.

The spacing means also includes a first plurality of bosses, e.g. see representative boss 56 in FIG. 2, integral with the underside of the flange 42, extending downwardly therefrom, and equiangularly spaced apart from each other in an annulus about the aforementioned axis; as well as a second plurality of bosses, e.g. see representative boss 58 in FIG. 2, integral with the upper side of the flange 44, extending upwardly therefrom, and equiangularly spaced apart from each other in an annulus about the aforementioned axis. The first and second plurality of bosses are arranged in pairs, e.g. bosses 56, 58, extending towards each other, each pair for each post. Each boss has an internally threaded bore which threadedly receives a respective one of the opposite end regions of a respective post, said post end regions being threaded, and preferably with pitches of opposite senses to permit adjustment of the clearance 54, as described in greater detail below.

As shown in FIG. 1, the interconnected members 12, 14 generally resemble two upside-down hats connected brim to brim by a plurality of upright narrow columns spaced well apart from one another. The open side 26 of member 12 freely communicates with the open side 28 of member 14 and with the exterior of the toy through the clearance 54.

The ball 16 is smaller in dimension than the clearance 54 so that the ball can be inserted without mechanical interference therethrough, and dropped through the open side of either one of the members 12, 14 and into the interior of the toy. To properly manipulate the toy, it is held by the flanges and then moved rotatively by hand, wrist, arm or other bodily movement generally about an axis which is perpendicular to the aforementioned axis about which the annular flanges 42, 44 extend, until the ball 16 within the toy moves in repetitive endless trajectories or orbital paths, e.g. 18 and 20. The object of the manipulation is to continue such rotative movement and thus keep the ball moving in its trajectories for as long as possible, while preventing the ball from escaping through the clearance to the exterior of the toy, which the ball might do because of its smaller cross-section and size as compared to that of the clearance.

As best shown in FIG. 2, in each trajectory when the toy is properly manipulated, the ball 16 travels, as shown by position A, in rolling engagement along the interior ball-guiding surface 36 of lower member 14 with sufficient momentum to pass through the open side 28 of the lower member 14 and to "fly" across or span the clearance 54 in a free-flying manner, as shown by position B, in a counterclockwise direction. Thereupon, the ball travels, as shown by position C, in rolling engagement along the interior ball-guiding surface 34 of upper member 12 with sufficient momentum to pass through the open side 26 of the upper member 12 and to "fly" across or span the clearance 54 in a free-flying manner, as shown by position D, in a clockwise direction. Due to the semi-spherical shape of the members 12, 14, the ball trajectory is elliptical. The ball 16 is positively guided due to its physical contact with a portion of the toy in positions A and C, but is not so positively guided in positions B and D, and the level of skill required is to prevent the ball from escaping to the exterior of the toy as shown by position E. As mentioned previously, more than one ball can be placed within the toy and caused to simultaneously move along such elliptical trajectories, thereby increasing the skill level required.

The members 12, 14 preferably are constituted of transparent or semi-transparent synthetic plastic material so that the ball within can easily be seen, and such ball preferably being colored or have luminance to add to the effect when the toy is in use and so as to be easily discernible through the curved wall of the members 12, 14. For educational or recreational purposes, the members may have some ornamentation thereon. For example, the ornamentation may be a simulation of the planet Earth's land masses, oceans and continental shapes so that the movement of the ball simulates the movement of a satellite in orbit around the planet Earth. The ornamentation may be a simulation of the Milky Way galaxy or the like so that the movement of the ball simulates the movement of a spaceship traveling around the galaxy. Other ornamentations are, of course, possible, including arrows indicating the preferred directions for moving the balls.

As mentioned previously, the size of the clearance 54 is adjustable. As shown for representative post 48 in FIG. 2, post 48 has one threaded end region **48*a* having a counterclockwise pitch which threadedly engages the threaded bore in boss 56, an opposite threaded end region 48*b* having a clockwise pitch which threadedly engages the threaded bore in boss 58, and a shank region 48*c* between the end regions 48*a*, 48*b*, which shank region preferably is left smooth and unthreaded. By turning the post 48 in one direction about its longitudinal axis, the flanges 42, 44 will move apart from each other, and by turning the post 48 in the opposite direction about its longitudinal axis, the flanges 42, 44** will move toward each other.

Figure 3:
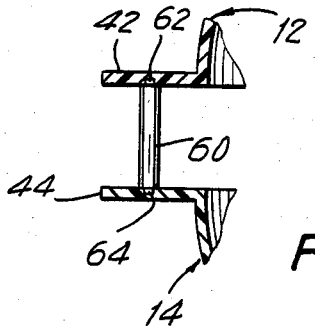
FIG. 3 is a partially broken-away view of a detail of another embodiment of the invention.

In cases where adjustability of the clearance 54 is not required or desired, the support posts can be made of a predetermined length and fixedly mounted between the flanges 42, 44. For example, as shown in FIG. 3, the opposite end regions 62, 64 of a representative post 60 have projections which are received with snap-type action in recesses formed in the flanges. The posts could also be molded in a one-piece construction with the members 12, 14.

Another technique for adjusting the clearance 54 is to provide sets of posts of different lengths. The user may select one of such sets and mount the same between the flanges. Thereupon, to change the size of the clearance, the user may detach the previously selected one set, and interchange the same with another set.

It will be understood that each of the elements described above, or two or more together, also may find a useful application in other types of constructions differing from the types described above.

While the invention has been illustrated and described as embodied in an orbiting action device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims;

I claim:

1. A manually-manipulatable action toy, comprising:

(A) a pair of generally dome-shaped hollow members, each having a closed side, an open side and a curved wall between the closed and open sides thereof, said hollow members being arranged in a mirror symmetrical relationship with the open side of one member facing the open side of the other member, each curved wall having an interior ball-guiding surface at the interior of the toy, and an exterior surface at the exterior of the toy;

(B) means for spacing the hollow members apart from each other and at a clearance between the open sides of the hollow members, said open sides freely communicating with each other and with the exterior of the toy through said clearance; and (C) a ball movable in repetitive endless trajectories between the hollow members in response to proper manual skillful manipulation of the toy, said ball traveling in each trajectory in rolling engagement along the interior ball-guiding surface of said one member with sufficient momentum to pass through the open side of said one member and to span said clearance in a free-flying manner in one direction, and thereupon traveling in rolling engagement along the interior ball-guiding surface of said other member with sufficient momentum to pass through the open side of said other member and to span said clearance in a free-flying manner in a countercurrent direction which is opposite to said one direction, said ball being dimensioned to be smaller than said clearance and to be freely insertable therethrough into the interior of the toy, said ball also being freely escapable through said clearance to the exterior of the toy in response to improper, unskillful manipulation thereof.

2. The action toy as defined in claim 1, wherein each hollow member has a semi-spherical configuration, and wherein each interior ball-guiding surface is concavely curved.

3. The action toy as defined in claim 1; and further comprising handle means on the hollow members for facilitating holding and manipulating the toy.

4. The action toy as defined in claim 3, wherein said handle means includes an outwardly-extending flange on each member at the open sides thereof, each flange having means for receiving the fingertips of a user.

5. The action toy as defined in claim 1, wherein said spacing means includes a plurality of elongated support posts equiangularly spaced apart from each other in an annulus about an axis, each of said support posts having the same length.

6. The action toy as defined in claim 1, wherein said spacing means includes means for adjusting the size of said clearance.

7. The action toy as defined in claim 6, wherein said adjusting means includes a plurality of threaded rods equiangularly spaced apart from each other in an annulus about an axis, each threaded rod threadedly engaging one of said members and threadedly engaging the other of said members, the size of said clearance being adjustable by rotating the threaded rods to a desired extent.

8. The action toy as defined in claim 6, wherein said adjusting means includes at least two sets of elongated support posts, each set having posts of the same length; and wherein the posts of one set have a different length than the posts of the other set; and wherein one of the sets is selected and mounted between the open sides of the members to define the size of said clearance.

9. A manually-manipulatable action toy, comprising:

(A) a pair of generally dome-shaped hollow semi-spherical members, each having a closed side, an open side and a curved wall between the closed and open sides thereof, said hollow members being arranged in a mirror symmetrical relationship with the open side of one member facing the open side of the other member, each curved wall having an interior concavelycurved ball-guiding surface at the interior of the toy, and an exterior surface at the exterior of the toy, each hollow member having an annular flange at the open side thereof and extending outwardly away from the interior of the toy, each flange being of sufficient dimension to be gripped by the fingertips of a user;

(B) means for spacing the hollow members apart from each other and at a clearance between the open sides of the hollow members, said open sides freely communicating with each other and with the exterior of the toy through said clearance, said spacing means including a plurality of elongated support posts equiangularly spaced apart from each other in an annulus about an axis; and (C) a ball movable in repetitive endless oval trajectories between the hollow members in response to proper manual skillful manipulation of the toy, said ball traveling in each trajectory in rolling engagement along the interior ball-guiding surface of said one member with sufficient momentum to pass through the open side of said one member and to span said clearance in a free-flying manner in one direction, and thereupon traveling in rolling engagement along the interior ball-guiding surface of said other member with sufficient momentum to pass through the open side of said other member and to span said clearance in a free-flying manner in a countercurrent direction which is opposite to said one direction, said ball being dimensioned to be smaller than said clearance and to be freely insertable therethrough into the interior of the toy, said ball also being freely escapable through said clearance to the exterior of the toy in response to improper, unskillful manipulation thereof.

10. The action toy as defined in claim 9, wherein a plurality of pairs of bosses are provided on the flanges, each pair for each post, each boss having an internally threaded bore with which a threaded end region of the respective post is threadedly received.

11. The action toy as defined in claim 10, wherein each support post has opposite threaded end regions of opposite pitch.

12. The action toy as defined in claim 9, wherein each support post has opposite end regions which snappingly engage recesses formed in the flanges.

* * * * *